US010220437B2

(12) United States Patent
Zhu et al.

(10) Patent No.: US 10,220,437 B2
(45) Date of Patent: Mar. 5, 2019

(54) WATER COOLED MOLD FOR CASTING ALUMINUM ALLOY WHEELS AND MANUFACTURING METHOD THEREOF

(71) Applicant: CITIC Dicastal CO., LTD, Qinhuangdao (CN)

(72) Inventors: Lin Zhu, Qinhuangdao (CN); Changhai Li, Qinhuangdao (CN); Hongbiao Li, Qinhuangdao (CN); Yong Li, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 28 days.

(21) Appl. No.: 15/337,712

(22) Filed: Oct. 28, 2016

(65) Prior Publication Data

US 2017/0120322 A1 May 4, 2017

(30) Foreign Application Priority Data

Oct. 30, 2015 (CN) ..... 2015 1 0725297

(51) Int. Cl.
*B22C 9/06* (2006.01)
*B22C 9/28* (2006.01)

(52) U.S. Cl.
CPC ..... *B22C 9/065* (2013.01); *B22C 9/28* (2013.01)

(58) Field of Classification Search
CPC ..... B29C 2043/522; B29C 47/807; B29C 47/827; F28F 1/00; F28F 13/0014;
(Continued)

(56) References Cited

U.S. PATENT DOCUMENTS 5,647,426 A * 7/1997 Prieto ..... B22C 9/28 164/122.1

FOREIGN PATENT DOCUMENTS

CN 203330381 U * 12/2013

OTHER PUBLICATIONS

Machine Translation of CN-203330381-U (Year: 2013).*

* cited by examiner

*Primary Examiner* — Matthew J Daniels
*Assistant Examiner* — Leith S Shafi
(74) *Attorney, Agent, or Firm* — Howard IP Law PLLC; Jeremy Howard

(57) ABSTRACT

The present invention provides a water cooled mold for casting aluminum alloy wheels and a manufacturing method thereof. The water cooled mold is provided with first-type water cooling channels with high heat exchange efficiency and second-type water cooling channels with low heat exchange efficiency. The first-type water cooling channels are concave grooves through which cooling water flows, and a cooling surface of the mold is in contact with open surfaces of the concave grooves. The second-type water cooling channels are grooves with stainless steel pipes, and the stainless steel pipes are in contact with the cooling surface of the mold. The second-type water cooling channels are installed on mold portions corresponding to wheel window positions of a cavity, and the first-type water cooling channels are installed on mold portions corresponding to spokes, flanges and rims of the cavity. The water cooled mold of the present invention is capable of accurately controlling a direction and a range of cooling within a three-dimensional space; the use of a thermal insulating groove is omitted so that the mold can be manufactured more simply and the service life of the mold can be prolonged; the cooling
(Continued)

efficiency is high and resources are saved; and the whole device is simple to manufacture and low in cost.

9 Claims, 2 Drawing Sheets

(58) Field of Classification Search
CPC ..... F28F 13/14; F28F 21/083; B21C 37/00; C22C 38/00; B22D 17/2038; B22D 17/2218; B22C 9/065; B22C 9/28
USPC ..... 249/56
See application file for complete search history.

WATER COOLED MOLD FOR CASTING ALUMINUM ALLOY WHEELS AND MANUFACTURING METHOD THEREOF

This application claims priority from CN 201510725297.2, filed on Oct. 30, 2015, the entire content of which is incorporated herein by reference.

TECHNICAL FIELD

The present invention relates to the field of casting, and in particular to a water cooled mold for casting aluminum alloy wheels and a manufacturing method thereof.

BACKGROUND ART

As each wheel manufacturing enterprise further researches the water cooled mold, the water cooled mold will be widely applied to production in the near future. However, the existing water cooled mold still has some problems.

The profile of a common wheel is shown in FIG. 1, and the front surface is composed of spokes and windows besides flanges. But now, the design manner of a water cooling channel is shown in FIG. 2, and the windows and the spokes are not differentiated but cooled uniformly. Those skilled in the art understand that conditions required by cooling are different in portions such as spokes, flanges, rims and the like of the wheel, especially casting hot spot portions. Undifferentiated cooling of all portions of the wheel will cause part of positions to be cooled unevenly. This may result in supercooling or insufficient cooling of part of the wheel, which may cause casting defects such as shrinkage porosity.

Because of many factors influencing production, it is difficult to analyze a single factor in details. The deficiencies of the design manner of the traditional water cooling channel are only analyzed:

a. the traditional water cooling channel has three cooling surfaces, i.e., a spatial range with a cooling range of 270° included angle, but only one surface parallel to a cast is in favor of cooling of the cast, which results in low cooling efficiency;

b. controlling the influence of the water cooling channel on other portions of the cast by means of a thermal insulating groove will cause damage to local rigidity of the mold and shorten the service life of the mold; and c. the windows and the spokes are not differentiated, and the window portions which do not need cooling are not avoided. The problems of the design manner of the traditional water cooling channel will certainly influence promotion of the water cooling channel in production, and in fact, the influence has emerged.

SUMMARY OF THE INVENTION

To overcome the above defects, an object of the present invention is to provide a cooling design method and device capable of effectively controlling cooling direction and range within a three-dimensional space to solve the existing problems.

In one aspect of the present invention, a water cooled mold for casting aluminum alloy wheels is provided, and is characterized in that: the water cooled mold is provided with first-type water cooling channels with high heat exchange efficiency and second-type water cooling channels with low heat exchange efficiency; the first-type water cooling channels with high heat exchange efficiency are concave grooves, the concave grooves are set to allow cooling water to flow through, and a cooling surface of the mold is in contact with open surfaces of the concave grooves; the second-type water cooling channels with low heat exchange efficiency are grooves with stainless steel pipes, and the stainless steel pipes are in contact with the cooling surface of the mold; the second-type water cooling channels with low heat exchange efficiency are installed on mold portions corresponding to wheel window positions of a cavity, and the first-type water cooling channels with high heat exchange efficiency are installed on mold portions corresponding to spokes, flanges and rims of the cavity.

In one preferable aspect of the present invention, the grooves with the stainless steel pipes in the second-type water cooling channels with low heat exchange efficiency are selected from concave grooves, L-shaped grooves and triangular grooves.

In one preferable aspect of the present invention, the surface roughness of the cooling surface of the first-type water cooling channels with high heat exchange efficiency is not less than 12.5.

In one preferable aspect of the present invention, the surface roughness of the cooling surface of the first-type water cooling channels with high heat exchange efficiency is measured as per GB/T 1031-2009.

In one preferable aspect of the present invention, the surface roughness of the cooling surface of the first-type water cooling channels with high heat exchange efficiency is 12.5 to 50.

In one preferable aspect of the present invention, the wall thickness of the concave grooves of the first-type water cooling channels with high heat exchange efficiency is 6 to 8 mm.

In one preferable aspect of the present invention, the distance between the cooling surface of the concave grooves of the first-type water cooling channel with high heat exchange efficiency and the seal weld grooves is 2 to 4 mm.

In one preferable aspect of the present invention, the stainless steel pipes and the grooves are fixed by means of spot welding in the second-type water cooling channels with low heat exchange efficiency.

In another aspect of the present invention, a method for manufacturing the abovementioned water cooled mold is provided, and is characterized in that first-type water cooling channels with high heat exchange efficiency and second-type water cooling channels with low heat exchange efficiency are installed on a cooling surface of the water cooled mold; the first-type water cooling channels with high heat exchange efficiency are concave grooves, the concave grooves are set to allow cooling water to flow through, and the cooling surface of the mold is in contact with open surfaces of the concave grooves; the second-type water cooling channels with low heat exchange efficiency are grooves with stainless steel pipes, and the stainless steel pipes are in contact with the cooling surface of the mold; the second-type water cooling channels with low heat exchange efficiency are installed on mold portions corresponding to wheel window positions of a cavity, and the first-type water cooling channels with high heat exchange efficiency are installed on mold portions corresponding to spokes, flanges and rims of the cavity.

In one preferable aspect of the present invention, a second-type water cooling channel with low heat exchange efficiency is installed on a mold portion corresponding to each wheel window position of the cavity.

In other aspects of the present invention, a technical solution is also provided as follows:

a cooling design method and device capable of effectively controlling cooling direction and range of the present invention are characterized in: comprising concave grooves 1, stainless steel pipes 4, L-shaped grooves 9, triangular grooves 10 and a mold 11.

The abovementioned cooling design method and device capable of effectively controlling the cooling direction and range are characterized in that: cooling channels are composed of the concave grooves 1 or the L-shaped grooves 9 or the triangular grooves 10, a cooling surface 3 and water channels 2.

The abovementioned cooling design method and device capable of effectively controlling the cooling direction and range are characterized in that: the concave grooves 1 or the L-shaped grooves 9 or the triangular grooves 10 are used to control the planar action range and direction of the cooling channels.

The abovementioned cooling design method and device capable of effectively controlling the cooling direction and range are characterized in that: the radial action range of the cooling channels is controlled by placing stainless steel pipes 4 into the concave grooves 1 or the L-shaped grooves 9 or the triangular grooves 10.

The abovementioned cooling design method and device capable of effectively controlling the cooling direction and range are characterized in that: the ranges of a key dimension 16 and a key dimension 117 are strictly controlled to be respectively 6 to 8 mm and 2 to 4 mm to better control the action range and direction of the cooling channels.

The technical solution of the present invention further includes: a cooling design method and device capable of effectively controlling the cooling direction and range comprise concave grooves 1, stainless steel pipes 4, L-shaped grooves 9, triangular grooves 10 and a mold 11.

In the whole cooling system, the concave grooves 1, a cooling surface 3 on the mold 11 and water channels 2 form complete cooling channels, and the number of the cooling surfaces of the cooling system is reduced to one from three in the traditional design method, i.e., the cooling range is changed to 90° from 270°, which enhances the cooling efficiency. The surface roughness of the cooling surface 3 is not less than 12.5.

Under the condition that the concave grooves 1 cannot be placed, the L-shaped grooves 9 or the triangular grooves 10 can be used as a substitute, and others remain unchanged.

The concave grooves 1 or the L-shaped grooves 9 or the triangular grooves 10 are used to control the planar action range and direction of the cooling channels.

The range of the key dimension I6 is 6 to 8 mm, the range of the key dimension II7 is 2 to 4 mm, and the thermal contact resistance between the concave grooves 1 and the mold 11 is increased as much as possible to better realize control on the cooling range.

The stainless steel pipes 4 are placed into the concave grooves 1 in portions corresponding to windows, the number of the stainless steel pipes 4 is equal to that of windows of a product, and the stainless steel pipes 4 are fixed by spot welding of slots 12 between the stainless steel pipes 4 and the concave grooves 1. Cooling water flows through the water channels 2 to exert cooling action on the cooling surface 3, and flows away from the stainless steel pipes 4 when flowing through the window portions. Because the stainless steel pipes 4 are in line contact with the cooling surface 3 of the mold 11, and the thermal contact resistance is very large, the cooling action of cooling water on the window portions can be ignored, i.e., the influence of the cooling system on the windows is eliminated.

The stainless steel pipes 4 are placed to control the cooling action range of the cooling channels in the radial direction.

The present invention has the following advantages: the direction and the range of cooling can be controlled accurately within a three-dimensional space; the use of a thermal insulating groove is omitted so that the mold can be manufactured more simply and the service life of the mold can be prolonged; the cooling efficiency is high and resources are saved; and the whole device is simple to manufacture and low in cost.

BRIEF DESCRIPTION OF DRAWINGS

In the following, embodiments of the present invention are described in detail in combination with figures, wherein.

Figure 1:
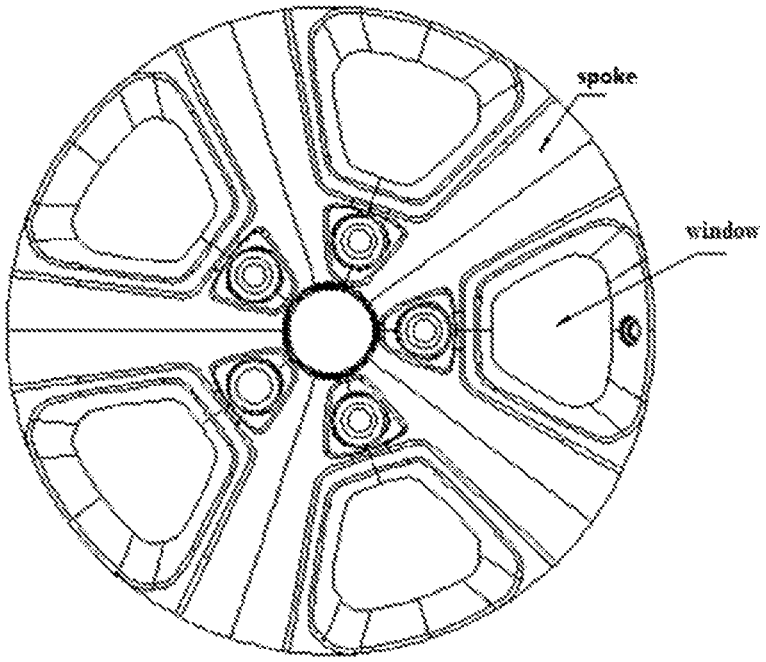
FIG. 1 is a schematic diagram of the profile of a wheel.
Figure 2:
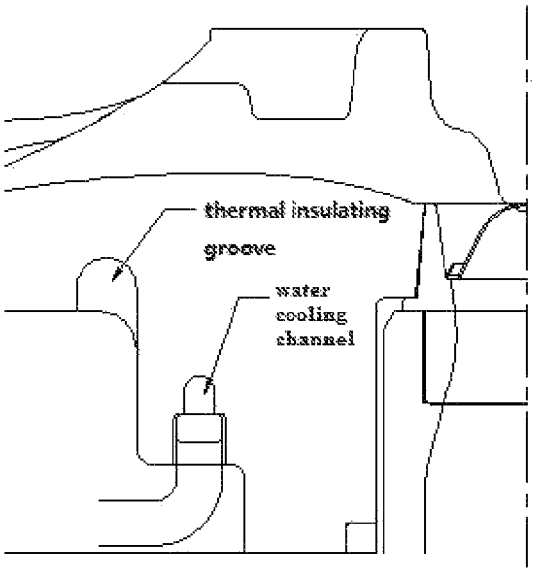
FIG. 2 is a design of a traditional water cooling channel.
Figure 3:
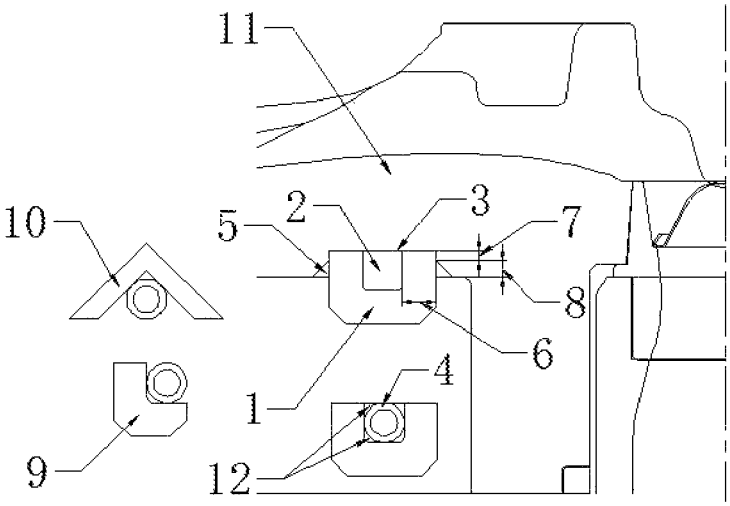
FIG. 3 is an improved design of the present invention.

In the figures, numeric symbols are as follows: 1-concave groove, 2-water channel, 3-cooling surface, 4-stainless steel pipe, 5-seal weld groove, 6-key dimension I, 7-key dimension II, 8-key dimension III, 9-L-shaped groove, 10-triangular groove, 11-mold, and 12-slot.

DETAILED DESCRIPTION OF THE INVENTION

Embodiment 1

A cooling design method and device capable of effectively controlling cooling direction and range of the present invention comprise concave grooves 1, stainless steel pipes 4, L-shaped grooves 9, triangular grooves 10 and a mold 11.

According to the drawing, a cooling surface 3 used to place the concave grooves 1 or the L-shaped grooves 9 or the triangular grooves 10 is processed on the mold 11, and a key dimension 16, a key dimension 117 and a key dimension 1118 are controlled as required.

The concave grooves 1 or the L-shaped grooves 9 or the triangular grooves 10 used to control the planar cooling range are processed, a plurality of stainless steel pipes 4 with the same radian as windows of a product are made, and the center diameter of the stainless steel pipes 4 is equal to that of water channels 2.

The prepared stainless steel pipes 4 are placed into the concave grooves 1 or the L-shaped grooves 9 or the triangular grooves 10 according to the distribution of the windows of a product and fixed by spot welding.

Finally, the concave grooves 1 or the L-shaped grooves 9 or the triangular grooves 10 are fitted on the cooling surface 3 of the mold 11, and sealed and fixed by full weld in seal weld grooves 5. The welding process is required to be performed after the mold is heated to 400° C., and the mold is required to be kept warm and cooled after welding.

The present invention relates to a cooling design method and device capable of effectively controlling cooling direction and range, which can be widely used in various metal mold casting fields.

The present invention discloses a cooling design method and device capable of effectively controlling cooling direction and range. Concave grooves 1 or L-shaped grooves 9 or triangular grooves 10 are used to control the planar action range and direction of cooling channels. The radial action range of the cooling channels is controlled by placing stainless steel pipes 4 into the concave grooves 1 or the L-shaped grooves 9 or the triangular grooves 10.

The cooling design method and device capable of effectively controlling the cooling direction and range of the present invention are not limited to the content of the present invention and the contents of specific embodiments. Other design manners obtained according to the enlightenment of the content of the present invention shall fall into the protection scope of the present invention.

The invention claimed is:

1. A water cooled mold for casting aluminum alloy wheels, characterized in that: the water cooled mold is provided with first-type water cooling channels with high heat exchange efficiency and second-type water cooling channels with low heat exchange efficiency; the first-type water cooling channels with high heat exchange efficiency are concave grooves, the concave grooves are set to allow cooling water to flow through, and a cooling surface of the mold is in contact with open surfaces of the concave grooves; the second-type water cooling channels with low heat exchange efficiency are grooves with stainless steel pipes, and the stainless steel pipes are in contact with the cooling surface of the mold; the second-type water cooling channels with low heat exchange efficiency are installed on mold portions corresponding to wheel window positions of a cavity, and the first-type water cooling channels with high heat exchange efficiency are installed on mold portions corresponding to spokes, flanges and rims of the cavity.

2. The water cooled mold according to claim 1, characterized in that the grooves with the stainless steel pipes in the second-type water cooling channels with low heat exchange efficiency are selected from concave grooves, L-shaped grooves and triangular grooves.

3. The water cooled mold according to claim 1, characterized in that the surface roughness of the cooling surface of the first-type water cooling channels with high heat exchange efficiency is not less than Ra 12.5.

4. The water cooled mold according to claim 1, characterized in that the surface roughness of the cooling surface of the first-type water cooling channels with high heat exchange efficiency is not less than Ra 12.5, wherein the surface roughness of the cooling surface of the first-type water cooling channels with high heat exchange efficiency is measured as per GB/T 1031-2009.

5. The water cooled mold according to claim 1, characterized in that the wall thickness of the concave grooves of the first-type water cooling channels with high heat exchange efficiency is 6 to 8 mm.

6. The water cooled mold according to claim 1, characterized in that the distance between the cooling surface of the concave grooves of the first-type water cooling channels with high heat exchange efficiency and the seal weld grooves is 2 to 4 mm.

7. The water cooled mold according to claim 1, characterized in that the stainless steel pipes and the grooves are fixed by means of spot welding in the second-type water cooling channels with low heat exchange efficiency.

8. The water cooled mold according to claim 1, characterized in that the surface roughness of the cooling surface of the first-type water cooling channels with high heat exchange efficiency is Ra 12.5 to Ra 50.

9. The water cooled mold according to claim 1, characterized in that the surface roughness of the cooling surface of the first-type water cooling channels with high heat exchange efficiency is Ra 12.5 to Ra 50, wherein the surface roughness of the cooling surface of the first-type water cooling channels with high heat exchange efficiency is measured as per GB/T 1031-2009.

* * * * *